US007552735B2

(12) United States Patent
Xue et al.

(10) Patent No.: US 7,552,735 B2
(45) Date of Patent: Jun. 30, 2009

(54) ACTIVATED CARBON FIBER CIGARETTE FILTER

(75) Inventors: Lixin Xue, Midlothian, VA (US); Jose G. Nepomuceno, Beaverdam, VA (US); Shuzhong Zhuang, Richmond, VA (US); Timothy Scott Sherwood, Midlothian, VA (US); John Bryant Paine, III, Midlothian, VA (US); Jay A Fournier, Richmond, VA (US); Charles Edwin Thomas, Jr., Richmond, VA (US); Kent Brian Koller, Chesterfield, VA (US); Liqun Yu, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 449 days.

(21) Appl. No.: 10/412,117

(22) Filed: Apr. 11, 2003

(65) Prior Publication Data

US 2003/0200973 A1 Oct. 30, 2003

(51) Int. Cl.
*A24D 3/04* (2006.01)
*A24D 3/06* (2006.01)

(52) U.S. Cl. ..... 131/339; 131/342

(58) Field of Classification Search ..... 131/331, 131/341, 342, 344, 202, 207
See application file for complete search history.

(56) References Cited

U.S. PATENT DOCUMENTS 5,191,905 A * 3/1993 Tsukamoto ..... 131/332
6,257,242 B1 7/2001 Stavridis

OTHER PUBLICATIONS

"Selective Removal of Semivolatile Components of Cigarette Smoke by Activated Carbon Fibers"; Atsushi Tokida et al; pp. T-539-T-547; vol. 41, No. 12 (1985).
"Selective Adsorption of the Vapor Phase Components of Cigarette Smoke by Activated Carbon Fibers"; Atsushi Tokida et al; pp. T-435-T443; vol. 42, No. 8 (1986).

* cited by examiner

*Primary Examiner*—Philip C Tucker
*Assistant Examiner*—Michael J Felton
(74) *Attorney, Agent, or Firm*—Connolly Bove Lodge & Hutz LLP

(57) ABSTRACT

A cigarette filter for removing gas phase constituents from mainstream cigarette smoke as the smoke is drawn through the filter primarily comprises an activated carbon fiber filter section including a bundle of activated carbon fibers. Particulate adsorbent materials such as granules, beads or course powders may be dispersed amongst the activated carbon fibers to aid in removal of the gas phase constituents. Additionally, the activated carbon fiber filter section may be used in combination with a separate bed or beds of particulate adsorbent material. In one embodiment, the activated carbon fibers are positioned within a helical groove on the outside of a threaded rod within the activated carbon fiber filter section. Relatively smaller amounts of activated carbon fibers produce the same smoke constituent reduction as larger amounts of particulate adsorbent material.

8 Claims, 1 Drawing Sheet

ACTIVATED CARBON FIBER CIGARETTE FILTER

BACKGROUND OF THE INVENTION

The present invention relates to cigarette filters comprising activated carbon fibers, and more particularly to cigarette filters comprising a bundle of activated carbon fibers with or without particulate adsorbent incorporated therein for removing gas phase constituents from mainstream tobacco smoke through adsorption of such gas phase constituents by the activated carbon fibers.

Activated carbon filters for adsorption and separation have been used in cigarette filter constructions. When granular activated carbon is used in a plug-space-plug filter configuration, for example, great care must be taken to ensure the carbon packed bed leaves no open space for the smoke to by-pass the activated carbon bed. Open spaces such as channels in the carbon bed lead to filtration inefficiencies.

Activated carbon in granular form has been used in the past to remove gas phase constituents in the cigarette smoke. In such methods, the mainstream smoke is contacted with the bed of granular activated carbon to adsorb the constituents to be removed. The removal efficiency of such methods is typically limited by the adsorbing capacity of the adsorbent bed, which is dictated by the total surface area and volume of pores in the micropore region accessible to the smokestream. Conventionally, micropores are defined as pores with widths less than 20 angstroms. The removal efficiency by such methods is also limited by the above described phenomenon of by-passing through the granular bed, whereby the smokestream passes through the bed without sufficient contact with the adsorbent for effective mass transfer. To counteract the loss of efficiency resulting from the limitation of the latter type, a typical solution is to construct the filter with a superfluous and redundant amount of adsorbent material to compensate for the loss of efficiency through by-passing. Activated carbon beds of the loose granular type incorporated within a cavity in the cigarette filter are susceptible to by-passing because a 100% fill is required to ensure a "fixed bed" of adsorbent with minimized channels. Such 100% fill is rarely achieved on a uniform basis using high speed manufacturing machinery. Another typical solution to avoiding by-passing of smoke through the bed is to use particulates with small diameters to ensure intimate contact of adsorbate with adsorbent; however, this solution typically leads to undesirably high pressure drops across the filter.

Adsorbing materials such as activated carbons, zeolites, silica gels and 3-aminopropylsilyl substituted silica gels (APS silca gels) are porous materials capable of removing gaseous components from cigarette smoke. Most of the commercially available adsorbing materials are in granular or powder forms. Materials in granular forms have difficulty in achieving the design or performance in a cigarette filter due to settling after the manufacturing process, whereas materials in powdered forms create too high a pressure drop to be practical.

Cigarette filters constructed using only crimped cellulose acetate tow lack activity in reducing smoke gas phase constituents such as formaldehyde, acetaldehyde, acrolein, 1,3-butadiene and benzene. Adsorbing materials such as activated carbons, zeolites, silica gels and APS silica gels capable of removing gaseous constituents from cigarette smoke may be deposited between the filaments of a cellulose acetate tow during the plug making process. However, the plasticizers (such as triacetin) often used in the process tend to reduce the activity of the included adsorbents. Other methods to include adsorbent materials in cigarette filters include sandwiching granules between cellulose acetate plugs in plug-space-plug configurations. To avoid high resistance-to-draw (RTD), only larger granules are used.

U.S. Pat. No. 6,257,242 discloses a filter element to reduce or eliminate vapor phase components of air or smoke. A first filter section contains activated carbon cloth while a second filter section contains a mixture of catalytic activated carbon and coconut activated carbon. Woven and nonwoven carbon cloth includes fibers transverse to the directional flow of mainstream smoke, and therefore result in less efficient use of carbon for adsorption purposes.

SUMMARY OF THE INVENTION

Accordingly, among the objects of the present invention is a cigarette filter that includes activated carbon fibers for the efficient and highly effective removal of gas phase constituents from mainstream cigarette smoke.

A cigarette filter for reduction of gas phase constituents from mainstream smoke comprises a bundle of activated carbon fibers held together in a cylindrical shape by a porous or non-porous plugwrap, for example, at a diameter substantially matching the diameter of the tobacco column. One type of activated carbon fiber used in this design is an isotropic pitch-derived microporous carbon fiber with nominal BET surface areas of approximately 1000 to 3000 square meters per gram, micropore volumes of approximately 0.30 to 0.80 cc/gram, and fiber diameters of 5 to 100 microns. Since these activated carbon fibers usually have a high degree of loft, the bundle of fibers exert a sufficient outward force against its wrapper to form a permeable filter medium with a "fixed bed" monolithic structure. The optimal weight of activated carbon fiber per unit length is selected to yield the desired pressure drop per unit length and without leaving sufficiently large open spaces through the medium which would result in by-pass and inefficiency in the removal of gas phase constituents.

Additionally, in a process for making these filters the activated carbon fibers, received as webs of either non-woven or continuous filament bundles are gathered, formed into tubular bundles, and wrapped with either a permeable or non-permeable wrap to form cigarette filter rods of active carbon fiber bundles. The resultant cylindrically-shaped filter medium of entangled actived carbon fibers presents a tortuous path for passage of incoming cigarette smoke through the active area of the fibers for efficient mass transfer and adsorption. By-passing of smoke is minimized by virtue of the tortuous nature of the flow through the fiber medium, while avoiding excessively high pressure drops across the filter. As a result, efficiency of gas phase constituent removal is improved, and less mass of adsorbent is required when such fibers are used than would be needed if particulate activated carbon were to be used to achieve the same removal efficiencies.

Using bundled activated carbon fibers to construct a monolithic filter has advantages when compared to other carbon structures in that (1) the loft of the activated carbon fiber bundles provides a permeable fixed adsorption bed with little opportunity for by-pass, and (2) the method and apparatus for transforming the activated carbon fibers into a monolithic structure (i.e., a monolithic structure comprised of a wrapped bundle of activated carbon fibers) lends itself more practically to high speed manufacturing operations.

Activated carbon fibers may be incorporated in a cigarette filter through utilization of a rod-like section of activated carbon fibers in combination with a second section of cellulose acetate filter. In this configuration, the activated carbon fiber section may be positioned closest to the tobacco rod and upstream of cigarette ventilation holes. The cellulose acetate section may be positioned at the mouth-end of the cigarette. By positioning the activated carbon fibers upstream of the ventilation holes, the flow rate of the smokestream is slower and a longer residence time with the adsorbent carbon fibers is achieved. Such longer residence time enhances mass transfer from the smokestream to the adsorbent.

In another configuration, a bundle of activated carbon fibers may be positioned downstream of cellulose acetate tow. Activated carbon fibers may also be blended with another filtration fiber such as cellulose acetate fibers. Both fibers are formed into a rod-like shape, cut into discrete lengths, and incorporated into the cigarette filter. The ratio of the blended fibers may be determined by the desired efficiencies of removal of gas phase and total particulate matter (TPM).

Overall, activated carbon fibers produce a higher efficiency of removal of gas phase constituents when compared to a similar mass of particulate adsorbent material. Also, the activated carbon fibers efficiently remove by impaction some of non-gas phase total particulate matter, thereby reducing the amount of cellulose acetate needed in the total cigarette filter. Accordingly, less proportion of the cigarette length is occupied by the total filter construction.

Other cigarette filter arrangements include activated carbon fibers in combination with a bed of particulate adsorbent material, such as activated carbon, silica gels, APS silica gels, zeolites and the like. A bundle of activated carbon fibers may be positioned on one end or opposite ends of the bed of particulate adsorbent material. Also, particulate adsorbent material may be incorporated into the activated carbon fibers in other filter arrangements.

Still another filter arrangement includes a threaded rod made from plastic, metal, wood or cellulose acetate aggregates, for example, with activated carbon fibers helically wound inside the threads of the rod. The activated carbon fibers may be blended with other types of fibrous adsorbing materials with different properties to achieve a smoke composition. During smoking, the smoke is directed along the helical groove to contact the adsorbing activated carbon fibers. Improved adsorption efficiency results from a longer path length when compared to longitudinally aligned carbon fibers. The helical groove allows a longer path length for a given amount of linear distance of the filter.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar referenced characters refer to similar parts and in which.

DETAILED DESCRIPTION OF THE INVENTION

Figure 1:
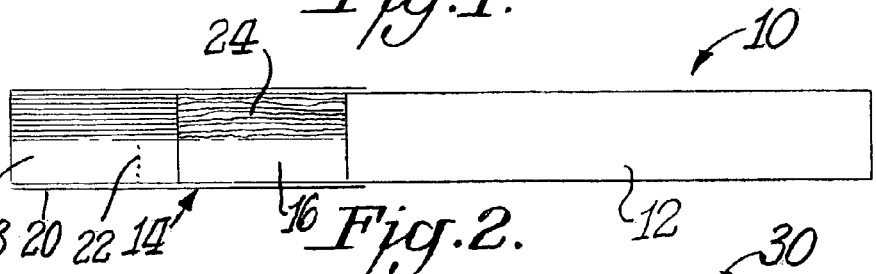
FIG. 1 is a side elevational view of a cigarette and filter, according to the present invention, with portions broken away to illustrate interior details.

Referring in more particularity to the drawings, FIG. 1 illustrates a cigarette 10 of the present invention comprising a tobacco rod 12 and a filter construction 14 including an activated carbon fiber filter section 16 and a cellulose acetate filter section 18. Tipping paper 20 is wrapped around the filter construction 14 and a portion of the adjacent tobacco rod 12 to hold the tobacco rod and filter construction together. The tipping paper has ventilation holes 22 for introducing air into mainstream tobacco smoke as the smoke is drawn through the filter. The location and number of ventilation holes may be varied depending on the performance characteristics desired in the final product.

The activated carbon fiber filter section 16 comprises a bundle of highly activated carbon fibers 24 that function to remove gas phase constituents in the cigarette smoke. The fibers have surface areas of approximately 1000 to 3000 square meters per gram, micropore volumes of approximately 0.30 to 0.8 cc/gram and fiber diameters of approximately 5 to 100 microns, preferably 5 to 50 microns.

U.S. Pat. Nos. 4,497,789 and 5,614,164 disclose carbon fibers and methods for the production of such carbon fibers. After proper activation the carbon fibers of this type may be used to form filter section 16. Both of these patents are incorporated herein by reference in their entirety for all useful purposes.

Filter section 16 has a rod-like shape comprising a cylinder of entangled carbon fibers 24 generally aligned with one another which provides a tortuous path for passage of incoming cigarette smoke through the active area of the fibers for efficient mass transfer and adsorption. Adverse by-passing of tobacco smoke is minimized by avoiding open spaces in the filter through the fibers 16, and excessively high pressure drops across the filter are avoided by controlling the packing density of the fibers. As a result, the efficiency of gas phase constituent removal is improved, and less mass of adsorbent material is required when such fibers are used than would be required if particulate activated carbon were to be used to achieve the same removal efficiencies.

As an alternative to the above filter construction the activated carbon fibers 24 may be blended with another filtration fiber such as cellulose acetate fibers, for example. Hence, the activated carbon fiber filter section 16 could be a blend of carbon fibers 24 and cellulose acetate fibers. The ratio of blended fibers may be determined by the desired efficiency of removal of both gas phase and total particulate matter (TPM).

Overall, the advantages of cigarette 10 and the above alternatives include a high efficiency of removal of gas phase constituents when compared to a similar mass of particulate adsorbents. Also, the activated carbon fibers 24 remove by impaction some of the non-gas phase TPM thereby reducing the amount of cellulose acetate needed. Cellulose acetate is traditionally used in filter constructions for the removal of TPM. As a result, less cigarette space is occupied by the total filter construction.

Experimental data showing relative efficiencies of removal of gas phase constituents in cigarette smoke are presented below in Table 1. In these experiments, the gas phase removal efficiencies were measured on a cigarette puff-by-puff basis, comparing the results of using 66 milligrams of activated carbon fibers versus using 180 milligrams of granular activated carbon. Results show that the gas phase constituents are effectively adsorbed to comparable extents by the activated carbon fibers while using approximately one third the mass of what was required of granulated activated carbon having a particularly high efficiency to achieve similar results. The rapid kinetics in using activated carbon fibers is fully evident in their superior performance in the first 5 or 6 puffs of the experiments. The data shows evidence of the start of a breakthrough at the point where relative reduction falls off in the latter puffs using 66 milligrams of activated carbon fiber.

TABLE 1

| | Control Cigarette (No Carbon) 1R4F* | | | Cigarette with 66 mg Activated Carbon Fiber in 20 mm filter length (CARBOFLEX ™ activated carbon fibers) | | | Cigarette with 180 mg of Pica activated carbon granules in plug-space-plug filter** | | |
|---|---|---|---|---|---|---|---|---|---|
| Constituent, puff # | Run 1 | Run 2 | Avg. | Run 1 | Run 2 | Avg. | Run 1 | Run 2 | Avg. |
| formaldehyde puff 1 | 58 | 47 | 52 | 4 | 5 | 4 | 5 | 5 | 5 |
| formaldehyde puff 2 | 16 | 20 | 18 | 3 | 3 | 3 | 5 | 4 | 4 |
| formaldehyde puff 3 | 6 | 6 | 6 | 2 | 2 | 2 | 4 | 4 | 4 |
| formaldehyde puff 4 | 3 | 5 | 4 | 2 | 2 | 2 | 4 | 4 | 4 |
| formaldehyde puff 5 | 2 | 3 | 3 | 1 | 2 | 2 | 2 | 3 | 3 |
| formaldehyde puff 6 | 2 | 2 | 2 | 3 | 1 | 2 | 3 | 4 | 4 |
| formaldehyde puff 7 | 2 | 2 | 2 | 3 | 2 | 2 | 2 | 4 | 3 |
| formaldehyde puff 8 | 2 | 1 | 2 | 2 | 2 | 2 | 2 | 5 | 3 |
| % Total Delivery VS Control | 90 | 86 | 88 | 20 | 19 | 20 | 27 | 34 | 30 |
| acrolein puff 1 | 3 | 3 | 3 | 0 | 0 | 0 | 0 | 0 | 0 |
| acrolein puff 2 | 7 | 7 | 7 | 0 | 0 | 0 | 0 | 0 | 0 |
| acrolein puff 3 | 8 | 9 | 9 | 0 | 0 | 0 | 0 | 0 | 0 |
| acrolein puff 4 | 9 | 10 | 10 | 0 | 0 | 0 | 0 | 0 | 0 |
| acrolein puff 5 | 8 | 10 | 9 | 2 | 1 | 1 | 0 | 0 | 0 |
| acrolein puff 6 | 13 | 13 | 13 | 4 | 2 | 3 | 0 | 0 | 0 |
| acrolein puff 7 | 14 | 14 | 14 | 1 | 1 | 1 | 0 | 0 | 0 |
| acrolein puff 8 | 18 | 16 | 17 | 3 | 3 | 3 | 0 | 0 | 0 |
| % Total Delivery VS Control | 82 | 82 | 82 | 10 | 7 | 8 | 0 | 0 | 0 |
| acetaldehyde puff 1 | 3 | 2 | 2 | 0 | 0 | 0 | 0 | 0 | 0 |
| acetaldehyde puff 2 | 6 | 4 | 5 | 0 | 0 | 0 | 0 | 0 | 0 |
| acetaldehyde puff 3 | 11 | 7 | 9 | 2 | 0 | 1 | 0 | 0 | 0 |
| acetaldehyde puff 4 | 11 | 8 | 9 | 0 | 0 | 0 | 0 | 0 | 0 |
| acetaldehyde puff 5 | 12 | 8 | 10 | 0 | 0 | 0 | 0 | 0 | 0 |
| acetaldehyde puff 6 | 15 | 11 | 13 | 1 | 1 | 1 | 0 | 0 | 0 |
| acetaldehyde puff 7 | 16 | 16 | 16 | 4 | 3 | 4 | 0 | 0 | 0 |
| acetaldehyde puff 8 | 18 | 19 | 19 | 12 | 12 | 12 | 1 | 0 | 0 |
| % Total Delivery VS Control | 91 | 76 | 83 | 19 | 16 | 18 | 2 | 0 | 1 |
| 1,3-butadiene puff 1 | 12 | 11 | 12 | 0 | 0 | 0 | 0 | 0 | 0 |
| 1,3-butadiene puff 2 | 14 | 14 | 14 | 0 | 0 | 0 | 0 | 0 | 0 |
| 1,3-butadiene puff 3 | 11 | 10 | 10 | 0 | 0 | 0 | 0 | 0 | 0 |
| 1,3-butadiene puff 4 | 10 | 8 | 9 | 0 | 0 | 0 | 0 | 0 | 0 |
| 1,3-butadiene puff 5 | 10 | 8 | 9 | 0 | 0 | 0 | 0 | 0 | 0 |
| 1,3-butadiene puff 6 | 11 | 10 | 11 | 1 | 0 | 0 | 0 | 0 | 0 |
| 1,3-butadiene puff 7 | 12 | 12 | 12 | 3 | 2 | 3 | 0 | 0 | 0 |
| 1,3-butadiene puff 8 | 13 | 12 | 12 | 7 | 6 | 6 | 0 | 0 | 0 |
| % Total Deliver VS Control | 93 | 84 | 88 | 12 | 8 | 10 | 1 | 0 | 0 |
| isoprene puff 1 | 7 | 10 | 9 | 1 | 0 | 0 | 0 | 0 | 0 |
| isoprene puff 2 | 11 | 14 | 12 | 0 | 0 | 0 | 0 | 0 | 0 |
| isoprene puff 3 | 12 | 12 | 12 | 0 | 0 | 0 | 0 | 0 | 0 |
| isoprene puff 4 | 14 | 10 | 12 | 0 | 0 | 0 | 0 | 0 | 0 |
| isoprene puff 5 | 12 | 8 | 10 | 0 | 0 | 0 | 0 | 0 | 0 |
| isoprene puff 6 | 12 | 10 | 11 | 1 | 0 | 0 | 0 | 0 | 0 |
| isoprene puff 7 | 14 | 15 | 15 | 3 | 1 | 2 | 0 | 0 | 0 |
| isoprene puff 8 | 15 | 17 | 16 | 5 | 4 | 5 | 0 | 0 | 0 |
| % Total Delivery VS Control | 98 | 95 | 97 | 10 | 6 | 8 | 1 | 0 | 1 |
| benzene puff 1 | 10 | 8 | 9 | 0 | 0 | 0 | 0 | 0 | 0 |
| benzene puff 2 | 13 | 12 | 13 | 0 | 0 | 0 | 0 | 0 | 0 |
| benzene puff 3 | 12 | 11 | 12 | 0 | 0 | 0 | 0 | 0 | 0 |
| benzene puff 4 | 12 | 10 | 11 | 0 | 0 | 0 | 0 | 0 | 0 |
| benzene puff 5 | 13 | 9 | 11 | 0 | 0 | 0 | 0 | 0 | 0 |
| benzene puff 6 | 13 | 12 | 12 | 0 | 0 | 0 | 0 | 0 | 0 |
| benzene puff 7 | 13 | 14 | 14 | 1 | 1 | 1 | 0 | 0 | 0 |
| benzene puff 8 | 14 | 15 | 14 | 3 | 2 | 2 | 0 | 0 | 0 |
| % Total Deliver VS Control | 100 | 91 | 96 | 6 | 3 | 5 | 1 | 0 | 1 |
| toluene puff 1 | 3 | 2 | 3 | 1 | 0 | 0 | 0 | 0 | 0 |
| toluene puff 2 | 9 | 8 | 8 | 0 | 0 | 0 | 0 | 0 | 0 |
| toluene puff 3 | 12 | 10 | 11 | 0 | 0 | 0 | 0 | 0 | 0 |
| toluene puff 4 | 13 | 12 | 12 | 0 | 0 | 0 | 0 | 0 | 0 |
| toluene puff 5 | 15 | 11 | 13 | 0 | 0 | 0 | 0 | 0 | 0 |

TABLE 1-continued

| Constituent, puff # | Control Cigarette (No Carbon) 1R4F* | | | Cigarette with 66 mg Activated Carbon Fiber in 20 mm filter length (CARBOFLEX ™ activated carbon fibers) | | | Cigarette with 180 mg of Pica activated carbon granules in plug-space-plug filter** | | |
|---|---|---|---|---|---|---|---|---|---|
| | Run 1 | Run 2 | Avg. | Run 1 | Run 2 | Avg. | Run 1 | Run 2 | Avg. |
| toluene puff 6 | 16 | 15 | 15 | 0 | 0 | 0 | 0 | 0 | 0 |
| toluene puff 7 | 17 | 18 | 17 | 1 | 0 | 1 | 0 | 0 | 0 |
| toluene puff 8 | 21 | 20 | 20 | 2 | 1 | 2 | 0 | 0 | 0 |
| % Total Deliver VS Control | 106 | 95 | 101 | 5 | 2 | 4 | 1 | 1 | 1 |
| ketene puff 1 | 105 | 90 | 97 | 10 | 6 | 8 | 19 | 1 | 10 |
| ketene puff 2 | 12 | 12 | 12 | 0 | 0 | 0 | 1 | 2 | 2 |
| ketene puff 3 | 0 | 0 | 0 | 0 | 0 | 0 | 2 | 0 | 1 |
| ketene puff 4 | 0 | 0 | 0 | 0 | 0 | 0 | 2 | 0 | 1 |
| ketene puff 5 | 0 | 0 | 0 | 0 | 0 | 0 | 0 | 0 | 0 |
| ketene puff 6 | 0 | 0 | 0 | 0 | 0 | 0 | 0 | 0 | 0 |
| ketene puff 7 | 0 | 0 | 0 | 0 | 0 | 0 | 0 | 0 | 0 |
| ketene puff 8 | 0 | 0 | 0 | 0 | 0 | 0 | 0 | 0 | 0 |
| % Total Deliver VS Control | 117 | 102 | 109 | 11 | 6 | 8 | 25 | 4 | 14 |

* Made by the University of Kentucky and universally used as a control in the tobacco industry.
**Space is substantially 100% filled with 180 mg of activated carbon granules, and as such the beneficial results of activated carbon fibers are even greater because most conventional commercial machinery does not routinely achieve 100% activated carbon granule fill.
NOTE:
The Pica activated carbon granules have a BET surface area of 1600 $m^2/g$ and a micropore volume of 0.52 $cm^3/g$ while the CARBOFLEX ™ activated carbon fibers have a BET surface area of 1300 $m^2/g$ and a micropore volume of 0.45 $cm^3/g$.

Figure 2:
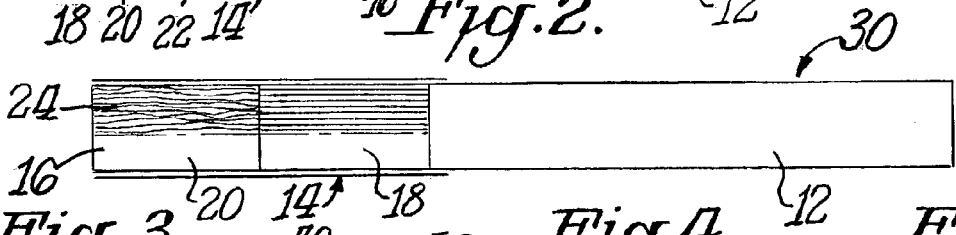
FIG. 2 is a side elevational view of another cigarette and filter, according to the present invention, with portions broken away to illustrate interior details.

FIG. 2 illustrates another cigarette 30 of the present invention similar in may respects to the cigarette 10 of FIG. 1, and similar reference characters are used to identify similar components. One significant difference in cigarette 30 is the reversal of locations of the activated carbon fiber filter section 16 and the cellulose acetate filter section 18. In cigarette 30, the carbon fibers 24 are downstream of the cellulose acetate 18. A mouth-end cellulose acetate plug may be included, if desired.

By way of example, CARBOFLEX™ activated carbon fibers 24 (supplied by Anshan East Asia Carbon Fibers Co. Ltd.) with BET surface area of approximately 1329 square meters per gram and micropore volume approximately 0.45 cubic centimeters per gram were fabricated into filter sections 16. These filter sections were constructed by bundling approximately 125 milligrams of active carbon fiber 24 into a filter rod 27 millimeters long and approximately 24.5 millimeters in diameter. These filter sections 16 were attached to control cigarettes (1R4F cigarettes) downstream of a cellulose acetate filter section 18 attached to each control cigarette thus producing the cigarette 30 shown in FIG. 2. Key gas phase constituents were quantified on a per puff basis in the smoke delivered from these cigarettes and compared to deliveries of these same compounds without the activated carbon fiber filter sections. Significant reductions in gas phase smoke constituents were observed as a result of the adsorption activity of the activated carbon fiber filters. These results are shown in Table 2 below.

TABLE 2

| Component | Acetaldehyde, μg/cigarette | Hydrogen Cyanide, μg/cigarette | Isoprene, μg/cigarette |
|---|---|---|---|
| Control Cigarette (1R4F) | 570 | 311 | 346 |
| Control Cigarette with Activated Carbon Fiber Filter Section Attached | 51 | 9 | 20 |
| % Reduction | 91% | 97% | 94% |

Figure 3:
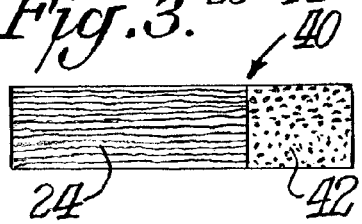
FIG. 3 is a longitudinal sectional view of another cigarette filter showing the carbon containing portions thereof, according to the present invention.
Figure 4:
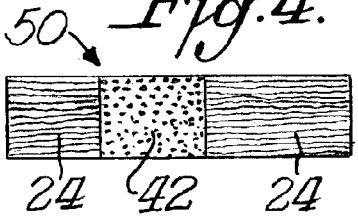
FIG. 4 is a longitudinal sectional view of still another cigarette filter showing the carbon containing portions thereof, according to the present invention.
Figure 5:
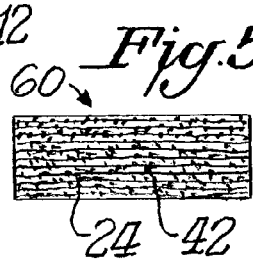
FIG. 5 is a sectional view of another cigarette filter showing the carbon containing portions thereof, according to the present invention.

FIGS. 3, 4 and 5 show several alternative cigarette filter constructions, particularly the carbon containing portions of such filter constructions. In each instance, a cellulose acetate filter section such as section 18 of FIG. 1 may be used at the mouth-end of the cigarettes incorporating these constructions, if desired.

FIG. 3 shows a cigarette filter 40 comprising the combination of a bundle of activated carbon fibers 24 and an adjacent bed of particulate adsorbent 42 such as carbon, silica gel, APS silica gel, or zeolite, for example. Another cigarette filter 50 is illustrated in FIG. 4 comprising a plug-space-plug arrangement wherein spaced apart bundles of activated carbon fibers 24 define a cavity therebetween with particulate adsorbent 42 filling the cavity. Still another cigarette filter 60 is shown in FIG. 5 comprising a bundle of activated carbon fibers 24 with particulate adsorbent 42 dispersed amongst the fibers. In each instance, the cigarette filters of FIGS. 3-5 function to adsorb gas phase constituents from mainstream tobacco smoke as the smoke passes therethrough. The amounts of activated carbon fibers and granular adsorbent are selected to achieve the desired reduction of such gas phase constituents.

Figure 6:
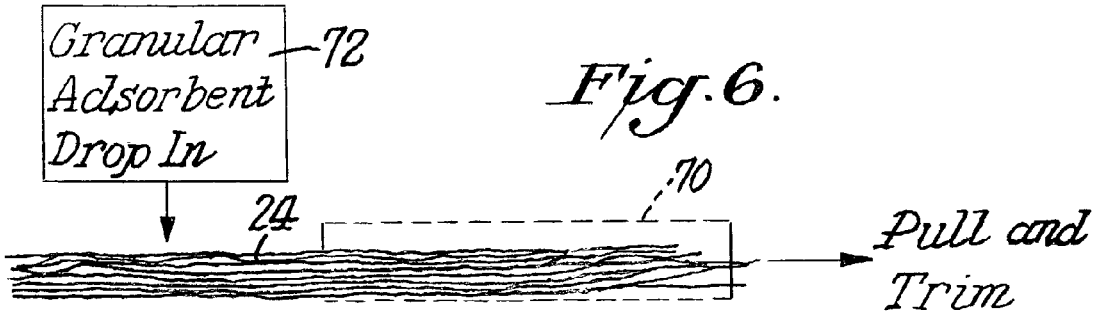
FIG. 6 is a diagrammatic view illustrating a procedure for producing a cigarette filter comprising a bundle of closely packed carbon fibers with or without granular adsorbent material incorporated therein, according to the present invention.

As diagrammatically shown in FIG. 6, the bundle of activated carbon fibers 24 of filter sections 16 of FIGS. 1 and 2 as well as the fiber bundles shown in FIGS. 3-5, may be formed by stretching a continuous bundle of adsorbent fibers of controlled total and per filament deniers through a pre-formed or in-situ formed tipping wrap 70 during the filter making process. After proper trimming and cutting, the formed filter may be inserted into a filter construction such as described above. The stretched adsorbent activated carbon fibers are contained and generally aligned with one another such that close to parallel pathways are created between the fibers to facilitate high TPM delivery. Random fiber orientation with some fibers transverse to smoke flow may excessively remove TPM. Small gas phase components of the smoke are effectively adsorbed by diffusing into the micropores of the aligned adsorbent fibers. Mainstream tobacco smoke flows in same direction as the aligned fibers.

High gas phase removal efficiency is the result of rapid adsorption kinetics and adequate total capacity of fine adsorbent fibers mostly in the range of 5 to 100, preferably 5 to 50 micrometers in diameter. Incorporating a certain amount of particulate adsorbent within the stretched adsorbent fibers operates to reduce the cost per capacity of the formed filter component. A particulate adsorbent drop-in 72 may be used to dispense particulate material 42 between and amongst the fibers 24 when producing the filter of FIG. 5, for example.

Using activated carbon fiber filter sections 16 of FIGS. 1 and 2 offers several unique advantages. First, continuous activated carbon fiber adsorbents can be incorporated into existing cigarette filters using high-speed processes. Second, due to the high loft nature of activated carbon fiber adsorbents, the "settling" problem associated with high speed manufacture of particulate beds does not exist. Third, activated carbon fiber adsorbents provide shorter gas diffusion paths than particulate adsorbents, and therefore increase the gas phase adsorption efficiency. Fourth, the uniform packing of the stretched aligned activated carbon fiber adsorbents allows uniform resistance-to-draw (RTD) and gas phase filtration performance for cigarette smoke. Finally, the close to parallel orientation of activated carbon fibers minimizes the loss of particulate phase of the smoke during the filtration process and therefore maximizes the TPM delivery of the cigarettes when such is desired. This is of value in cigarettes or electrically heated cigarette embodiments when high delivery of TMP is desired.

By compensating with particulate adsorbents in filter section 60 of FIG. 5, or using filter sections 16 or 60 in the embodiments of FIG. 3 or 4, the formed filters not only maintain the advantage of using activated carbon fiber adsorbents, but also have lower total cost per equal capacity.

Using CARBOFLEX™ activated carbon fiber, hand made cigarette examples of filter sections 16 and 60 have been prepared and tested. From the testing results noted below in Table 3 and Table 4, it is clear the formed filters not only effectively remove gas phase components such as AA (acetaldehyde), HCN (hydrogen cyanide), MeOH (methanol) and ISOP (isoprene), but also possess high TPM delivery and low RTD. It is noteworthy that in filter section 60, replacing about half the amount of the carbon fiber with lower cost carbon granules provides comparable total filtration performance.

TABLE 3

| Sample | Filter | AA/TPM | HCN/TPM | MEOH/TPM | ISOP/TPM | TPM (mg) | RTD (mm $H_2O$) | GAC (mg) (granular activated carbon) | CA (mg) |
|---|---|---|---|---|---|---|---|---|---|
| 1R4F* | 1000× Avg./TPM | 45.6 | 6.9 | 6.0 | 27.8 | 11.8 | 140 | 0 | 190.0 |
| | Relative Std. Deviation Absolute Delivery | 9% | 5% | 9% | 7% | 4% | 5% | | 2% |
| 1* | CA Blank (No Plasticizer) Relative Delivery to 1R4F | −7% | −16% | −5% | −8% | 14.6 | 120 | 0 | 161.5 |
| 2* | CA Blank (No Plasticizer) Relative Delivery to 1R4F | −4% | 2% | −2% | −19% | 13.6 | 119 | 0 | 161.9 |
| 3* | Pica Carbon Granules in Blank (No Plasticizer) Relative Delivery to 1R4F | −52% | −71% | −65% | −81% | 11.5 | 142 | 103 | 155 |
| 4* | Pica Carbon Granules in Blank (No Plasticizer) Relative Delivery to 1R4F | −51% | −73% | −73% | −84% | 10.3 | 158 | 107 | 161 |
| | | Carbon Fiber Plugs* | | | | | | | CF (mg) |
| 5** | CARBOFLEX ™- Relative Delivery to 1R4F - A1 | −83% | −78% | −76% | −94% | 14.9 | 106 | 0 | 88 |
| 6** | CARBOFLEX ™- Relative Delivery to 1R4F - A2 | −62% | −52% | −65% | −76% | 20.8 | 94 | 0 | 75 |
| 7** | CARBOFLEX ™- Relative Delivery to 1R4F - D1 | −66% | −60% | −61% | −86% | 11.6 | 80 | 48 | 44 |
| 8** | CARBOFLEX ™- Relative Delivery to 1R4F - D2 | −72% | −66% | −64% | −88% | 16.8 | 80 | 55 | 50 |

*27-mm long filter plug.

**20-mm long plug combined with a 7-mm long cellulose acetate plug.

TABLE 4

| | 1R4F Control (27-mm CA long filter plug) | | CARBOFLEX ™-A (20-mm long plug combined with 7-mm CA plug) | | CARBOFLEX ™-D (20-mm long plug combined with 7-mm CA plug) | |
|---|---|---|---|---|---|---|
| Sample | Average | Std. Dev. | A3 | A4 | D3 | D4 |
| RTD (mm $H_2O$) | 137 | 2% | 88 | 88 | 87 | 86 |
| DDI % | 25% | 4% | 18 | 22 | 20 | 25 |
| Activated Carbon Fiber (mg) | 0 | 0 | 66 | 66 | 69 | 69 |
| Pica Granular Carbon (mg) | 0 | 0 | 0 | 0 | 114 | 115 |
| Gas Phase Components | Control | | Reduction vs: Control | | | |
| Propene | 90 | 9% | −60% | −63% | −84% | −88% |
| Hydrogen Cyanide | 89 | 13% | −44% | −48% | −80% | −85% |
| Propadiene | 94 | 13% | −72% | −71% | −81% | −89% |
| 1,3-Butadiene | 96 | 8% | −88% | −92% | −92% | −96% |
| Isoprene | 107 | 5% | −91% | −94% | −94% | −96% |
| 1,3-Cyclopentadiene | 98 | 5% | −89% | −92% | −93% | −95% |
| 1,3-Cyclohexadiene | 100 | 17% | −94% | −96% | −95% | −96% |
| Methyl-1,3-cyclopentadiene | 102 | 9% | −93% | −97% | −94% | −96% |
| Formaldehyde | 100 | 14% | −80% | −81% | −75% | −79% |
| Acetaldehyde | 92 | 9% | −79% | −83% | −96% | −97% |
| Acrolein | 86 | 14% | −88% | −92% | −93% | −94% |
| Acetone | 98 | 12% | −93% | −95% | −95% | −97% |
| 2,3-Butanedione | 102 | 5% | −95% | −97% | −94% | −96% |
| 2-Butanone | 99 | 4% | −96% | −98% | −96% | −98% |
| 3-Methylbutanal | 62 | 90% | −82% | −89% | −84% | −87% |
| Benzene | 99 | 8% | −94% | −97% | −94% | −96% |
| Toluene | 100 | 7% | −95% | −98% | −94% | −96% |
| Butyronitrile | 96 | 8% | −94% | −97% | −92% | −95% |
| 2-Methylfuran | 101 | 4% | −92% | −96% | −93% | −96% |
| 2,5-Dimethylfuran | 105 | 5% | −93% | −97% | −93% | −96% |
| Hydrogen Sulfide | 96 | 7% | −49% | −56% | −86% | −89% |
| Carbonyl Sulfide | 98 | 6% | −37% | −39% | −68% | −76% |
| Methyl Mercaptan | 100 | 6% | −72% | −74% | −87% | −91% |
| 1-Methylpyrrole | 97 | 8% | −91% | −94% | −94% | −95% |
| Ketene | 109 | 11% | −90% | −94% | −97% | −96% |
| Acetylene | 94 | 13% | −33% | −35% | — | −54% |

Figure 7:
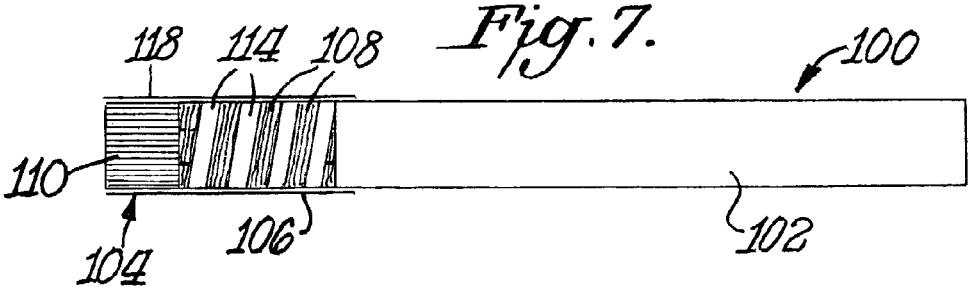
FIG. 7 is a side elevational view of another cigarette and filter, according to the present invention, with portions broken away to illustrate interior details.
Figure 8:
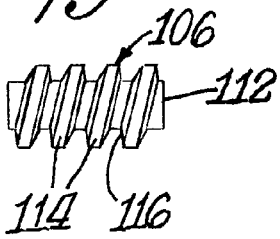
FIG. 8 is an exploded sectional view of the threaded rod of the cigarette filter shown in FIG. 7.

FIGS. 7 and 8 illustrate a further embodiment of the present invention comprising a cigarette 100 having a tobacco rod 102 and a filter 104 including a cylindrical threaded rod 106, activated carbon fibers 108 and a cellulose acetate plug 110. The threaded rod consists of a solid cylinder 112 around which an inclined plane winds helically, either right or left handed, thereby producing a thread 114 and a corresponding groove 116. In cross-section the thread ridge forming the inclined plane may be triangular, square or rounded, for example. Correspondingly, the cross-section of the groove 116 may be approximately triangular, square or rounded. The threaded rod 106 should be sized such that when contained within tipping paper 118, a helical channel or pathway is created for the cigarette smoke. The bundle of substantially aligned activated carbon fibers 108 is wound helically inside the groove along the rod. The axial length of the threaded rod, the shape and the area of the groove cross-section, and the pitch (the longitudinal distance from any point on one thread to a corresponding point on the next successive thread) may be altered to achieve a desired total path-length and resulting RTD, and thereby meet an adsorption requirement. The diameter of the activated carbon fibers may be in the range of 5 to 100, preferably 5 to 50 microns with surface areas of approximately 1000 to 3000 square meters per gram and micropore volumes of approximately 0.30 to 0.80 cc per gram. The threaded rod 106 may be made of a variety of materials including plastic, metal, wood or cellulose aggregates, for example. During smoking, the smoke is directed along the helical groove to contact the bundle of carbon fibers contained therein. An advantage is that the helical groove allows a longer path length for a given amount of linear extent of the filter.

What is claimed is:

1. A cigarette filter for removing gas phase constituents from mainstream cigarette smoke as the smoke is drawn through the filter, the filter including an activated carbon fiber filter section containing a bundle of activated carbon fibers substantially aligned with one another and having a common direction, and wherein the activated carbon fiber filter section includes a threaded rod having a helical groove on the outside thereof, and wherein the bundle of activated carbon fibers is positioned in the groove.

2. A cigarette filter as in claim 1 including particulate adsorbent material dispersed amongst the activated carbon fibers.

3. A cigarette filter as in claim 2 wherein the particulate adsorbent material is selected from the group consisting of activated carbon, silica gel, APS silica gel and zeolite.

4. A cigarette filter as in claim 1 wherein the thread rod is constructed of material selected from the group consisting of plastic, metal, wood and cellulose aggregates.

5. A cigarette filter as in claim 1 including at least one cellulose acetate filter section adjacent to the activated carbon fiber filter section.

6. A cigarette comprising a tobacco rod and a downstream filter for removing gas phase constituents from mainstream tobacco smoke as the smoke is drawn through the filter, the filter including an activated carbon fiber filter section containing a bundle of activated carbon fibers substantially aligned with one another in the same direction as the flow of tobacco smoke through the filter, and wherein the activated carbon fiber filter section includes a threaded rod having a helical groove on the outside thereto and wherein the bundle of activated carbon fibers is positioned in the groove.

7. A cigarette as in claim 6 including particulate adsorbent material dispersed amongst the activated carbon fibers.

8. A cigarette as in claim 6 wherein the thread rod is constructed of material selected from the group consisting of plastic, metal, wood and cellulose aggregates.

* * * * *